US008960163B2

(12) United States Patent
Iwaya et al.

(10) Patent No.: US 8,960,163 B2
(45) Date of Patent: Feb. 24, 2015

(54) FUEL EVAPORATION GAS DISCHARGE SUPPRESSING DEVICE OF INTERNAL COMBUSTION ENGINE

(71) Applicant: Mitsubishi Jidosha Kogyo Kabushiki Kaisha, Tokyo (JP)

(72) Inventors: Norifumi Iwaya, Tokyo (JP); Takayuki Sano, Tokyo (JP); Atsushi Wakamatsu, Tokyo (JP); Hiroaki Kageyama, Tokyo (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/092,557

(22) Filed: Nov. 27, 2013

(65) Prior Publication Data

US 2014/0144411 A1 May 29, 2014

(30) Foreign Application Priority Data

Nov. 28, 2012 (JP) ..... 2012-259457

(51) Int. Cl.
*F02M 25/08* (2006.01)
*F02D 41/00* (2006.01)

(52) U.S. Cl.
CPC ..... *F02M 25/08* (2013.01); *F02D 41/0032* (2013.01); *F02M 25/0836* (2013.01)
USPC ..... 123/520

(58) Field of Classification Search
CPC . F02M 25/08; F02M 25/0836; F02M 25/089; F02D 41/0032; F02D 41/004
USPC ..... 123/516, 518, 519, 520
See application file for complete search history.

(56) References Cited

U.S. PATENT DOCUMENTS

| | | | | |
|---|---|---|---|---|
| 4,887,578 | A * | 12/1989 | Woodcock et al. | 123/519 |
| 5,111,795 | A * | 5/1992 | Thompson | 123/519 |
| 5,647,334 | A * | 7/1997 | Miller | 123/520 |
| 5,806,500 | A * | 9/1998 | Fargo et al. | 123/520 |
| 6,367,457 | B1 * | 4/2002 | Mancini et al. | 123/516 |
| 6,435,164 | B1 * | 8/2002 | Kaiser et al. | 123/516 |
| 7,762,241 | B2 * | 7/2010 | Childress et al. | 123/520 |
| 8,019,525 | B2 * | 9/2011 | DeBastos et al. | 701/102 |
| 8,056,540 | B2 * | 11/2011 | DeBastos et al. | 123/521 |
| 8,447,495 | B2 * | 5/2013 | Pearce et al. | 701/103 |
| 8,863,729 | B2 * | 10/2014 | Menke | 123/518 |
| 2004/0089275 | A1 | 5/2004 | Kidokoro et al. | |

FOREIGN PATENT DOCUMENTS

JP 4110932 B2 7/2008

* cited by examiner

*Primary Examiner* — Thomas Moulis
(74) *Attorney, Agent, or Firm* — Birch, Stewart, Kolasch & Birch, LLP

(57) ABSTRACT

A fuel evaporation gas discharge suppressing device of an internal combustion engine includes a gas storage tank for storing a fuel evaporation gas in a communication passage for causing an air intake passage and a fuel tank in an internal combustion engine of a vehicle to communicate with each other in the communication passage. Control unit controls canister opening/closing unit, fuel tank opening/closing unit and gas tank opening/closing unit based on an internal pressure of the fuel tank. The control unit opens the canister opening/closing unit and opens the fuel tank toward the communication passage, and then opens the gas storage tank toward the communication passage when reducing the internal pressure of the fuel tank.

18 Claims, 3 Drawing Sheets

FUEL EVAPORATION GAS DISCHARGE SUPPRESSING DEVICE OF INTERNAL COMBUSTION ENGINE

BACKGROUND

The present invention relates to a fuel evaporation gas discharge suppressing device of an internal combustion engine.

As the technique for preventing discharge of a fuel evaporation gas evaporated in a fuel tank to the air, conventionally, there are provided a canister communicating with the fuel tank and a closing valve to be controlled to seal the fuel tank in a case other than oil filling at a passage between the fuel tank and the canister. The closing valve is opened to cause the fuel evaporation gas to flow toward the canister in the oil filling and the fuel evaporation gas is thus adsorbed by the canister.

If the fuel tank is sealed by the closing valve, however, a pressure in the fuel tank is increased to be higher due to evaporation of a fuel in the fuel tank when an outside air temperature is raised.

In that case, in order to prevent discharge of the fuel evaporation gas to the air with the oil supply, the closing valve is opened when an oil filling operation is detected, and a filler port is prohibited from being opened until the pressure in the fuel tank is reduced sufficiently.

However, a long period of time is taken until the pressure in the fuel tank is reduced. For this reason, a great deal of time is required until the oil filling is started.

Consequently, there is developed the technique for opening the closing valve to discharge the fuel evaporation gas in the fuel tank to an air intake passage of an engine without adsorbing the fuel evaporation gas into the canister, thereby reducing the pressure in the fuel tank if the engine is being operated and purging is being carried out when the pressure in the fuel tank is raised (Patent Document 1).

[Patent Document 1] JP-B-4110932

SUMMARY

It is an object of the invention to provide a fuel evaporation gas discharge suppressing device of an internal combustion engine which can efficiently reduce a latency time required for reduction in a pressure in a fuel tank.

According to an aspect of the present invention, there is provided a fuel evaporation gas discharge suppressing device of an internal combustion engine, comprising:

a communication passage communicating an air intake passage with a fuel tank in the internal combustion engine of a vehicle;

a canister for adsorbing a fuel evaporation gas in the communication passage;

a gas storage tank for storing the fuel evaporation gas in the communication passage;

a canister opening/closing unit for opening the canister to the communication passage or closing the canister;

a fuel tank opening/closing unit for opening the fuel tank to the communication passage or closing the fuel tank;

a gas tank opening/closing unit for opening the gas storage tank to the communication passage or closing the gas storage tank; and a control unit for controlling the canister opening/closing unit, the fuel tank opening/closing unit and the gas tank opening/closing unit, based on an internal pressure of the fuel tank, wherein the control unit opens the gas storage tank to the communication passage after the control unit opens the canister opening/closing unit and the fuel tank to the communication passage, to reduce the internal pressure of the fuel tank.

The fuel evaporation gas discharge suppressing device of an internal combustion engine may further comprise an operating unit for accepting an operation for opening a filler port of the fuel tank, wherein the control unit reduces the internal pressure of the fuel tank when the operation for opening the filler port is accepted by the operating unit.

The fuel evaporation gas discharge suppressing device of an internal combustion engine may further comprise a pressure detecting unit for detecting the internal pressure of the fuel tank, wherein, when the internal pressure of the fuel tank is equal to or less than a predetermined value, the control unit closes the canister and opens the gas storage tank to the communication passage.

The fuel evaporation gas discharge suppressing device of an internal combustion engine may be configured such that the predetermined value is determined based on a capacity and an internal pressure of the gas storage tank.

The fuel evaporation gas discharge suppressing device of an internal combustion engine may be configured such that an internal pressure of the gas storage tank is kept to be negative pressure, and the negative pressure is generated by actuation of the internal combustion engine.

The fuel evaporation gas discharge suppressing device of an internal combustion engine may further comprise a communication opening/closing unit for opening and closing a communication between the communication passage and the air intake passage, wherein the control unit intermittently opens and closes the communication opening/closing unit during work of the internal combustion engine to cause the communication passage and the air intake passage to intermittently communicate with each other, and closes the canister and opens the gas storage tank to the communication passage to cause the internal pressure of the gas storage tank to be negative pressure.

DETAILED DESCRIPTION OF EXEMPLIFIED EMBODIMENTS

In an evaporated fuel processing device described in the Patent Document 1, a purge vacuum switching valve (a purge solenoid valve) for opening and closing a communication passage for introducing a fuel evaporation gas into an air intake passage and the closing valve are simultaneously controlled to be opened or closed during an operation of an engine in order to reduce a pressure in a fuel tank, and the purge solenoid valve and the closing valve are cooperated with each other. Since the fuel evaporation gas discharged to the air intake passage of the engine via the communication passage passes through an inner part of a canister, however, a part of the fuel evaporation gas may be adsorbed into the canister and an amount of the fuel evaporation gas which can be adsorbed into the canister may be decreased in oil filling.

In the evaporated fuel processing device described in the Patent Document 1, moreover, there is a problem in that control is difficult to perform when a vehicle is a hybrid car and a working time for an engine is limited.

The invention has been made to solve the problems and has an object to provide a fuel evaporation gas discharge suppressing device of an internal combustion engine which can efficiently reduce a latency time required for a drop in a pressure in the fuel tank.

An embodiment of the fuel evaporation gas discharge suppressing device of an internal combustion engine according to the invention will be described below in detail with reference to the accompanying drawings.

Figure 1:
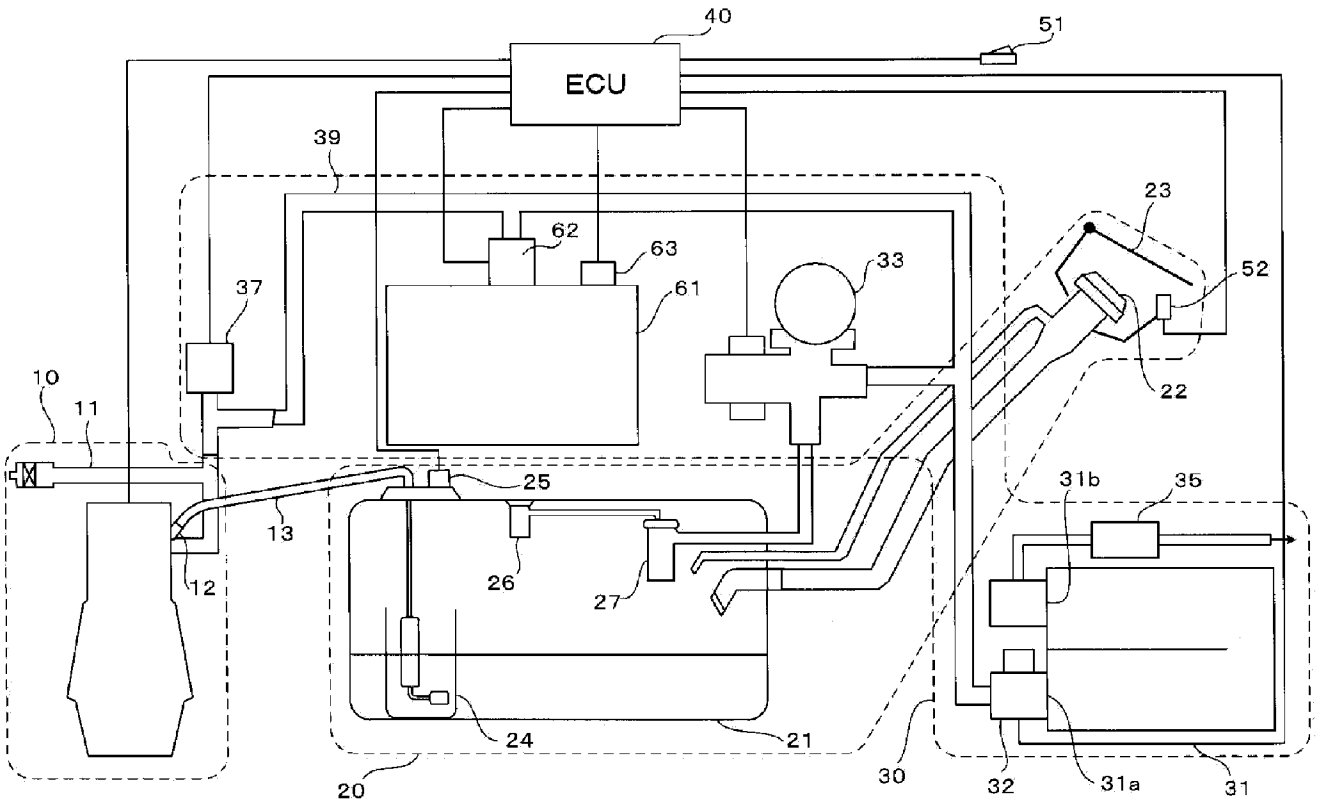
FIG. 1 is a schematic view showing a fuel evaporation gas discharge suppressing device according to an embodiment of the present invention.

FIG. 1 is a schematic view showing the fuel evaporation gas discharge suppressing device according to the embodiment.

As shown in FIG. 1, the fuel evaporation gas discharge suppressing device according to the embodiment is roughly formed by an engine (an internal combustion engine) 10 to be provided on a vehicle, a fuel storage portion 20 for storing a fuel of the engine 10, a fuel evaporation gas processing portion 30 for processing an evaporation gas of the fuel which is evaporated in the fuel storage portion 20, and an electronic control unit (hereinafter referred to as an ECU) 40 which is a control device for generally controlling the vehicle.

In the embodiment, it is assumed that a vehicle provided with the fuel evaporation gas discharge suppressing device is a hybrid car which is equipped with the engine 10 and a motor (an electric motor) which is not shown and runs by driving force of the engine 10 and the motor. Referring to the vehicle which is the hybrid car, a state in which the engine 10 is working will be referred to as a CS (Charging Sustain) mode and a state in which the engine 10 is not working will be referred to as a CD (Charging Deplete) mode.

In the embodiment, the engine 10 is a 4-cycle serial 4-cylinder gasoline engine of a multi point injection (MPI) type. The engine 10 includes an air intake passage 11 for taking air into a combustion chamber of the engine 10 and a fuel injection valve 12 for injecting a fuel into an air intake port of the engine 10 is provided on a downstream of the air intake passage 11. A fuel pipe 13 is connected to the fuel injection valve 12 so that a fuel is supplied. In the embodiment, the vehicle is the hybrid car as described above. For this reason, the engine 10 does not work all the time but works in only a necessary timing by control of the ECU 40.

The fuel storage portion 20 is formed by a fuel tank 21, a fuel filler port 22, a fuel filler port cover 23, a fuel pump 24, a fuel tank pressure sensor (pressure detecting unit) 25, a fuel cutoff valve 26, a leveling valve 27, a fuel filler port cover opening/closing switch (operating unit) 51, and a filler port cover sensor 52.

The fuel tank 21 stores a fuel for the engine 10. The fuel filler port 22 is a fuel inlet to the fuel tank 21. The fuel filler port cover 23 serves as a cover for the fuel filler port 22 provided on a body of a vehicle. The fuel pump 24 supplies the fuel from the fuel tank 21 to the fuel injection valve 12 via the fuel pipe 13. The fuel tank pressure sensor 25 detects a pressure in the fuel tank 21. The fuel cutoff valve 26 prevents the fuel from flowing from the fuel tank 21 into the fuel evaporation gas processing portion 30. The leveling valve 27 controls a liquid level in the fuel tank 21 in oil filling. A fuel evaporation gas generated in the fuel tank 21 is discharged from the fuel cutoff valve 26 to an outside of the fuel tank 21 via the leveling valve 27.

The fuel filler port cover opening/closing switch 51 accepts an operation for opening the filler port (the fuel filler port cover 23) of the fuel tank. In the case in which the operation for opening the fuel filler port cover 23 is carried out with respect to the fuel filler port cover opening/closing switch 51, a fuel filler port cover opening mechanism (not shown) is controlled by the ECU 40 so that the fuel filler port cover 23 is opened. As will be described below, in the ECU 40, the fuel filler port cover 23 is opened after an internal pressure of the fuel tank 21 has a value which is equal to or smaller than a predetermined value. The filler port cover sensor 52 detects the opening/closing operation of the fuel filler port cover 23.

The fuel evaporation gas processing portion 30 is formed by a canister 31, a canister closing valve (canister opening/closing unit) 32, a tank closing valve (tank opening/closing unit) 33, an air filter 35, a purge solenoid valve (communication passage opening/closing unit) 37, a purge pipe (a communication passage) 39, a sub tank (a gas storage tank) 61, a sub tank closing valve (gas tank closing unit) 62, and a sub tank pressure sensor 63.

The canister 31 has an activated carbon therein. Moreover, the canister 31 is provided with an evaporation gas flowing hole 31*a* through which a fuel evaporation gas generated in the fuel tank 21 or a fuel evaporation gas adsorbed into the activated carbon flows. Furthermore, the canister 31 is provided with an outside air suction hole 31*b* for sucking outside air when discharging the fuel evaporation gas adsorbed into the activated carbon. Moreover, the outside air suction hole 31*b* is connected to communicate with one of sides of the air filter 35. The air filter 35 serves to prevent dust from entering from an outside and has the other side opened to the air.

One of sides of the canister closing valve 32 is connected to communicate with the evaporation gas flowing hole 31*a* of the canister 31. Moreover, the other side of the canister closing valve 32 is connected to communicate with the purge pipe 39 to be a communication passage for causing an air intake passage of the engine 10 to communicate with the fuel tank 21. The canister closing valve 32 has a function for opening the canister 31 toward the purge pipe 39 serving as the communication passage or closing the canister 31.

In the embodiment, the canister closing valve 32 is an electromagnetic valve of a normal opening type which is opened in a non-conduction state and is brought into a valve closing condition when a driving signal is supplied from an outside (the ECU 40 in the embodiment) so that a conduction state is set. The canister closing valve 32 is brought into a valve opening condition when the non-conduction state is set, and causes the canister 31 to communicate with the purge pipe 39, thereby enabling flow of the fuel evaporation gas into or out of the canister 31. Moreover, the canister closing valve 32 is brought into the valve closing condition when the driving signal is supplied from the ECU 40 so that the conduction state is set, and thus disables the flow of the fuel evaporation gas into or out of the canister 31.

The fuel tank closing valve 33 is provided on the purge pipe 39 and opens the fuel tank 21 toward the purge pipe 39 serving as the communication passage or closes the fuel tank 21. The fuel tank closing valve 33 is an electromagnetic valve of a normal closing type which is closed in a non-conduction state and is brought into a valve opening condition when the driving signal is supplied from the outside so that the conduction state is set. The fuel tank closing valve 33 is brought into a valve closing condition when the non-conduction state is set, and brings the fuel tank 21 into a sealing state, thereby disabling the flow of the fuel evaporation gas generated in the fuel tank 21 to the outside of the fuel tank 21. Moreover, the fuel tank closing valve 33 is brought into the valve opening condition when the driving signal is supplied from the outside (ECU 40) so that the conduction state is set, and thus enables the flow of the fuel evaporation gas into the purge pipe 39.

The purge solenoid valve 37 is provided on the purge pipe 39 between the air intake passage 11 of the engine 10 and the sub tank 61. The purge solenoid valve 37 is an electromagnetic valve of a normal closing type which is closed in a non-conduction state and is brought into a valve opening condition when a driving signal is supplied from the outside so that a conduction state is set. The purge solenoid valve 37 is brought into a valve closing condition when the non-conduction state is set, and closes the purge pipe 39, thereby disabling the flow of the fuel evaporation gas from the fuel evaporation gas processing portion 30 to the engine 10. Moreover, the purge solenoid valve 37 is brought into the valve opening condition and opens the purge pipe 39 when the driving signal is supplied from the outside (ECU 40) so that the conduction state is set, and thus enables the flow of the fuel evaporation gas to the engine 10.

The sub tank 61 is provided between the fuel tank closing valve 33 of the purge pipe 39 and the purge solenoid valve 37. An internal pressure of the sub tank 61 is kept to be negative, and the fuel evaporation gas flowing from the fuel tank 21 is caused to flow into an inner part by the negative pressure and is temporarily stored therein. The negative pressure of the sub tank 61 is generated by the actuation of the engine 10.

The sub tank closing valve 62 is an electromagnetic valve of a normal closing type which is closed in a non-conduction state and is brought into a valve opening condition when a driving signal is supplied from the outside so that a conduction state is set. The sub tank closing valve 62 is brought into a valve closing condition when the non-conduction state is set, and thus brings the sub tank 61 into a sealing state, thereby disabling the flow of the fuel evaporation gas generated in the fuel tank 21 to the outside of the sub tank 61. Moreover, the sub tank closing valve 62 is brought into the valve opening condition when the driving signal is supplied from the outside (ECU 40) so that the conduction state is set, thereby enabling the flow of the fuel evaporation gas into the sub tank 61. Furthermore, the sub tank pressure sensor 63 detects a pressure in the sub tank 61.

The ECU 40 is a control device for generally controlling a vehicle and includes an input/output device, a storage device (such as an ROM, an RAM or a nonvolatile RAM), a central processing unit (CPU) and a timer.

The fuel tank pressure sensor 25, the sub tank pressure sensor 63, the fuel filler port cover opening/closing switch 51 and the filler port cover sensor 52 are connected to an input side of the ECU 40, and detected information are input from these sensors.

On the other hand, the engine 10, the canister closing valve 32, the fuel tank closing valve 33, the purge solenoid valve 37 and the sub tank closing valve 62 are connected to an output side of the ECU 40.

The ECU 40 controls to open and close the canister closing valve 32, the fuel tank closing valve 33, the purge solenoid valve 37 and the sub tank closing valve 62 (which will be hereinafter referred to as "respective closing valves"), thereby controlling the pressure in the fuel tank 21 based on the detected information sent from various sensors. In the case in which the operation for opening the fuel filler port cover 23 is carried out with respect to the fuel filler port cover opening/closing switch 51, particularly, the ECU 40 opens the fuel filler port cover 23 after the internal pressure of the fuel tank 21 is equal to or less than a predetermined value, which is an atmospheric pressure or less in the embodiment, in such a manner that the fuel is not blown out.

Figure 2:
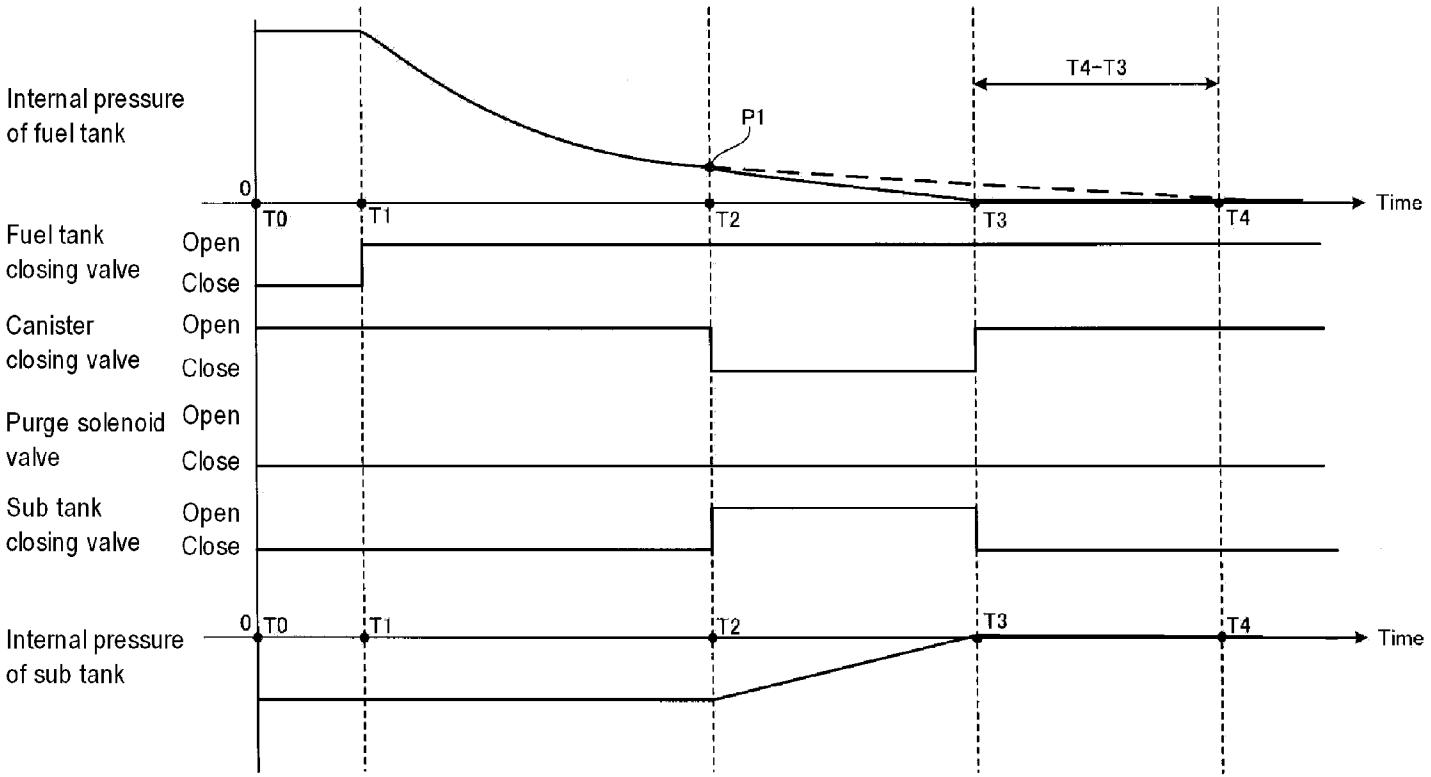
FIG. 2 is a chart showing, in time series, actuation of each closing valve and a change of an internal pressure of a tank in the case in which an operation for opening a filler port is executed.

FIG. 2 is a chart showing, in time series, actuation of each closing valve and a change of the internal pressure of the tank in the case in which the operation for opening the filler port is carried out.

FIG. 2 shows, in time series, the internal pressure of the fuel tank 21, the opening/closing state of the fuel tank closing valve 33, the opening/closing state of the canister closing valve 32, the opening/closing state of the purge solenoid valve 37, the opening/closing state of the sub tank closing valve 62, and the internal pressure of the sub tank 61 from top to bottom. The internal pressure of the fuel tank 21 is a detection value of the fuel tank pressure sensor 25. The internal pressure of the sub tank 61 is a detection value of the sub tank pressure sensor 63. Zero on an axis of ordinate does not indicate zero atm but an atmospheric pressure.

Referring to the internal pressure of the fuel tank 21, a dotted line indicates a change of the internal pressure of the fuel tank 21 in the case in which pressure reduction is carried out via the canister 31 without use of the sub tank 61 (the conventional method).

At a time of T0 to T1 in FIG. 2, all valves are kept in the non-conduction state, the fuel tank closing valve 33 is closed, the fuel evaporation gas stays in the fuel tank 21, and the internal pressure of the fuel tank 21 has a greater value than the atmospheric pressure by the fuel evaporation gas. Moreover, the canister closing valve 32 is opened, and the purge solenoid valve 37 and the sub tank closing valve 62 are closed. Furthermore, the internal pressure of the sub tank 61 is held to be negative.

When the operation for opening the fuel filler port cover 23 (switch-ON operation) is carried out with respect to the fuel filler port cover opening/closing switch 51 at the time T1, the ECU 40 first opens the fuel tank closing valve 33 to cause the fuel evaporation gas in the fuel tank 21 to flow into the purge pipe 39. In other words, the ECU 40 opens the canister closing valve 32 and opens the fuel tank 21 toward the communication passage when reducing the internal pressure of the fuel tank 21. Although the internal pressure of the fuel tank 21 is reduced, consequently, a speed of the pressure reduction is decreased with passage of time.

When the internal pressure of the fuel tank 21 becomes a predetermined value P1 (or a smaller value than the predetermined value P1) at a time T2, the ECU 40 opens the sub tank closing valve 62 and closes the canister closing valve 32 with the fuel tank closing valve 33 opened. In other words, when the internal pressure of the fuel tank 21 is equal to or smaller than the predetermined value, the canister 31 is closed, and at the same time, the sub tank 61 is opened toward the communication passage. The sub tank closing valve 62 is opened so that the fuel evaporation gas flows into the sub tank 61 and the internal pressure of the fuel tank 21 is further reduced. The canister closing valve 32 is closed in order to prevent outside air from flowing into the purge pipe 39 through the outside air suction hole 31*b*, thereby reducing the internal pressure of the fuel tank 21 efficiently. On the other hand, the internal pressure of the sub tank 61 is raised to approximate to the atmospheric pressure.

When the internal pressure of the fuel tank 21 is equal to the atmospheric pressure at a time T3, the ECU 40 closes the sub tank closing valve 62 and opens the canister closing valve 32 with the fuel tank closing valve 33 opened. Then, the ECU 40 opens the fuel filler port cover 23 to bring a state in which the oil can be supplied to the fuel tank 21.

On the other hand, as shown in a dotted line in the change of the internal pressure of the fuel tank 21, the internal pressure of the fuel tank 21 makes a change on an asymptote basis without occurrence of acceleration of the pressure reduction after the time T2 in the case in which the sub tank 61 is not used (the conventional method). At a time T4, finally, the internal pressure of the fuel tank 21 is equal to the atmospheric pressure. As shown in FIG. 2, the time T4 is later than the time T3.

In the fuel evaporation gas discharge suppressing device according to the embodiment, thus, in the case in which the operation for opening the fuel filler port cover 23 is carried out with respect to the fuel filler port cover opening/closing switch 51, the fuel tank 21 is opened toward the purge pipe 39, the canister 31 is opened toward the purge pipe 39 and the sub tank 61 is closed until the internal pressure of the fuel tank 21 is equal to or less than the first predetermined value P1, and the canister 31 is closed and the sub tank 61 is opened toward the purge pipe 39 when the internal pressure of the fuel tank 21 is equal to or less than the first predetermined value P1. By using the sub tank 61, thus, it is possible to shorten a time required for bringing a state in which the operation for opening the fuel filler port cover 23 is executed and the oil filling to the fuel tank 21 can be then carried out. In the example of FIG. 2, it is possible to shorten a difference between the time T4 and the time T3.

The first predetermined value P1 for defining a timing for opening the sub tank 61 (the time T2) is determined by the ECU 40 based on a capacity and an internal pressure (a negative pressure) of the sub tank 61. In this case, if the capacity and the negative pressure of the sub tank 61 are increased, the first predetermined value P1 is set to be greater and the sub tank 61 is opened in an earlier timing.

Subsequently, description will be given to a method of causing the sub tank 61 to have a negative pressure. As described above, the fuel evaporation gas discharge suppressing device causes the sub tank 61 to have the negative pressure by a negative pressure generated by the actuation of the engine 10.

Figure 3:
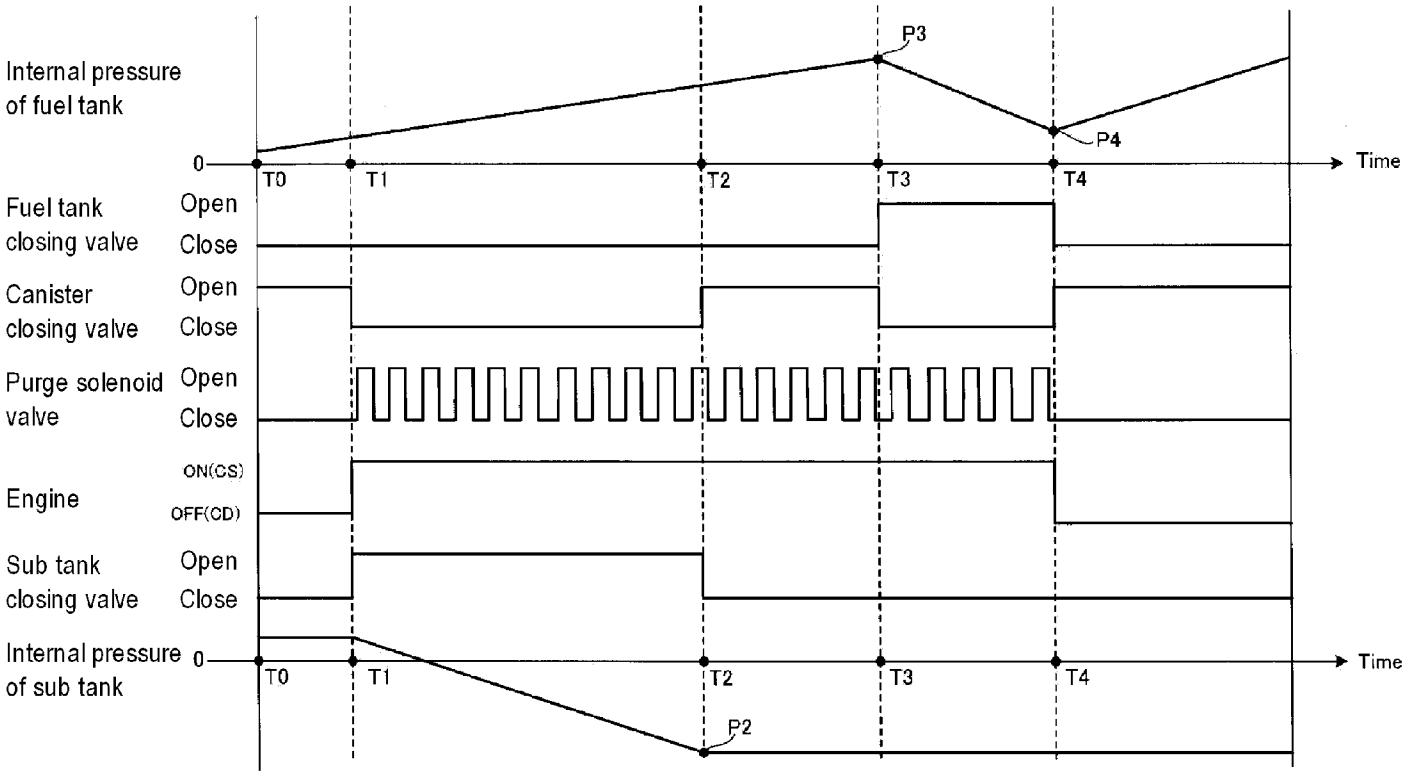
FIG. 3 is a chart showing, in time series, the actuation of each closing valve and the transition of the internal pressure of the tank during vehicle running.

FIG. 3 is a chart showing, in time series, the actuation of each closing valve and the change of the internal pressure of the tank during vehicle running.

FIG. 3 shows, in time series, the internal pressure of the fuel tank 21, the opening/closing state of the fuel tank closing valve 33, the opening/closing state of the canister closing valve 32, the opening/closing state of the purge solenoid valve 37, the working state of the engine 10, the opening/closing state of the sub tank closing valve 62, and the internal pressure of the sub tank 61 from top to bottom. The internal pressure of the fuel tank 21 is equivalent to a detection value of the fuel tank pressure sensor 25. The internal pressure of the sub tank 61 is equivalent to a detection value of the sub tank pressure sensor 63. Zero on an axis of ordinate does not indicate zero atm but an atmospheric pressure.

FIG. 3 shows the working state of the engine 10 in addition to the items in FIG. 2. As described above, the vehicle provided with the fuel evaporation gas discharge suppressing device is a hybrid car and runs while switching a CS mode in which the engine 10 is working and a CD mode in which the engine 10 is not working under control of the ECU 40.

At a time of T0 to T1 in FIG. 3, the engine 10 is set to the CD mode and is not working. Moreover, various valves are kept in a non-conduction state, the fuel tank closing valve 33 is closed, the fuel evaporation gas stays in the fuel tank 21, and the internal pressure of the fuel tank 21 is raised with passage of time. Moreover, the canister closing valve 32 is opened, and the purge solenoid valve 37 and the sub tank closing valve 62 are closed. Furthermore, the internal pressure of the sub tank 61 is made equal to or higher than the atmospheric pressure by the fuel evaporation gas flowing in the previous oil filling.

When the engine 10 is set to the CS mode and thus starts working at the time T1, the ECU 40 opens the sub tank closing valve 62 and closes the canister closing valve 32. Then, the purge solenoid valve 37 is intermittently opened. An opening/closing valve of the purge solenoid valve 37 is duty-controlled in consideration of an air/fuel ratio. At this time, the fuel tank closing valve 33 is kept to be closed.

The sub tank closing valve 62 is opened so that the fuel evaporation gas in the sub tank 61 flows into the purge pipe 39 and the internal pressure of the sub tank 61 is reduced. The canister closing valve 32 is closed in order to prevent the outside air from flowing into the purge pipe 39 through the outside air suction hole 31*b*, thereby reducing the internal pressure of the sub tank 61 efficiently.

Moreover, the purge solenoid valve 37 is opened. Consequently, the air intake passage 11 of the engine 10, the purge pipe 39 and the sub tank 61 are caused to communicate with each other so that the fuel evaporation gas is sucked out of the air intake passage 11, the inner part of the purge pipe 39 and the inner part of the sub tank 61 by a negative intake pressure. Consequently, the air intake passage 11, the inner part of the purge pipe 39 and the sub tank 61 are caused to have negative pressures.

When the internal pressure of the sub tank 61 is equal to or less than a second predetermined value P2 at a time T2, the ECU 40 closes the sub tank closing valve 62. The second predetermined value P2 is set to be a sufficient negative pressure value. Consequently, the sub tank 61 is completely set to have a negative pressure. At the time T2, the canister closing valve 32 is opened to cause the inner part of the purge pipe 39 to have an atmospheric pressure, and the purge solenoid valve 37 is continuously opened/closed to supply, to the engine 10, the fuel evaporation gas adsorbed into the activated carbon of the canister 31, thereby performing canister purge for carrying out combustion by unit of the engine 10.

On the other hand, the fuel tank closing valve 33 is kept to be closed and the internal pressure of the fuel tank 21 is raised with time. When the internal pressure of the fuel tank 21 is equal to or higher than a third predetermined value P3 at a time T3, the ECU 40 opens the fuel tank closing valve 33 to cause the fuel evaporation gas in the fuel tank 21 to flow into the purge pipe 39 in order to prevent the fuel tank 21 from being damaged, and furthermore, opens/closes the purge solenoid valve 37 to supply the fuel evaporation gas to the engine 10, thereby carrying out combustion by unit of the engine 10 (fuel tank purge).

When the internal pressure of the fuel tank 21 is equal to or less than a fourth predetermined value P4 at a time T4, the ECU 40 closes the fuel tank closing valve 33 and closes the purge solenoid valve 37. Moreover, the canister closing valve 32 is opened to bring the various valves into the non-conduction state.

In the fuel evaporation gas discharge suppressing device according to the embodiment, thus, the purge solenoid valve 37 is intermittently opened and closed during the work of the engine 10 to cause the purge pipe 39 and the air intake passage 11 of the engine 10 to intermittently communicate with each other, and the canister 31 is closed and opens the sub tank 61 is opened toward the purge pipe 39 so that the internal pressure of the sub tank 61 becomes a negative pressure. By causing the sub tank 61 to have a negative pressure during the work of the engine 10, consequently, it is possible to efficiently reduce the internal pressure of the fuel tank 21 in the oil filling.

As described above, the fuel evaporation gas discharge suppressing device according to the embodiment includes the sub tank 61 for storing the fuel evaporation gas in the purge pipe 39 and the sub tank closing valve 62 for opening the sub tank 61 toward the purge pipe 39 or closing the sub tank 61, opens the canister closing valve 32 and opens the fuel tank 21 toward the purge pipe 39, and then opens the sub tank 61 toward the purge pipe 39 when reducing the internal pressure of the fuel tank 21. When reducing the internal pressure of the fuel tank 21, consequently, the device opens the sub tank closing valve 62 and the fuel tank closing valve 33 to store, in the sub tank 61, the fuel evaporation gas in the fuel tank 21. Thus, it is possible to rapidly reduce the internal pressure of the fuel tank 21.

Moreover, the fuel evaporation gas discharge suppressing device closes the canister 31 and opens the sub tank 61 toward the purge pipe 39 when the internal pressure of the fuel tank 21 is equal to or less than the predetermined value. Consequently, the fuel evaporation gas is discharged via the canister 31 in the same manner as in the related art until the internal pressure of the fuel tank 21 is equal to or less than the predetermined value, that is, for a period in which a discharging speed is comparatively high, and the fuel evaporation gas is stored in the sub tank 61 after the internal pressure of the fuel tank 21 has a value which is equal to or smaller than the predetermined value, that is, when the discharging speed is comparatively decreased. Thus, it is possible to efficiently reduce the internal pressure of the fuel tank 21.

Furthermore, the fuel evaporation gas discharge suppressing device reduces the internal pressure of the fuel tank 21 in the case in which the operation for opening the filler port is carried out. Therefore, a user can rapidly supply oil.

In the fuel evaporation gas discharge suppressing device, the timing for opening the sub tank 61 is determined based on the capacity and internal pressure of the sub tank 61. Therefore, it is possible to determine the timing for opening the sub tank 61 corresponding to an amount of the fuel evaporation gas which can be stored in the sub tank 61. Consequently, it is possible to efficiently reduce the internal pressure of the fuel tank 21.

In addition, the fuel evaporation gas discharge suppressing device can rapidly move the evaporation fuel gas in the fuel tank 21 into the sub tank 61 because the sub tank 61 has the internal pressure kept to be negative. Moreover, the negative pressure in the sub tank 61 is generated by the actuation of the engine 10. For this reason, it is not necessary to separately provide a mechanism for generating a negative pressure. Thus, it is possible to simplify the structure of the fuel evaporation gas discharge suppressing device.

Furthermore, the fuel evaporation gas discharge suppressing device intermittently opens/closes the purge solenoid valve 37 during the work of the engine 10 to cause the purge pipe 39 to intermittently communicate with the air intake passage 11, and closes the canister 31 and opens the sub tank 61 toward the communication passage. By using the negative intake pressure of the engine 10, consequently, it is possible to cause the internal pressure of the sub tank 61 to be negative.

Also in the case in which a vehicle is a hybrid car which is provided with the engine 10 and an electric motor (a motor) and runs by operating the engine 10 and the electric motor under the control of the ECU 10, the fuel evaporation gas discharge suppressing device can generate a negative pressure for a limited working period of the engine 10.

Although the description has been given to the case in which the internal pressure of the fuel tank is reduced in the oil filling in the embodiment, the application of the invention is not restricted thereto but the invention can also be applied when the internal pressure of the fuel tank is to be reduced, for example, in the case in which a failure might occur in a fuel system.

Although it is assumed that the vehicle provided with the fuel evaporation gas discharge suppressing device is the hybrid car in the embodiment, the application of the invention is not restricted thereto but the invention can also be applied to a car provided with only the engine 10.

What is claimed is:

1. A fuel evaporation gas discharge suppressing device of an internal combustion engine, comprising:

a communication passage communicating an air intake passage with a fuel tank in the internal combustion engine of a vehicle;

a canister for adsorbing a fuel evaporation gas in the communication passage;

a gas storage tank for storing the fuel evaporation gas in the communication passage;

a canister opening/closing unit for opening the canister to the communication passage or closing the canister;

a fuel tank opening/closing unit for opening the fuel tank to the communication passage or closing the fuel tank;

a gas tank opening/closing unit for opening the gas storage tank to the communication passage or closing the gas storage tank; and a control unit for controlling the canister opening/closing unit, the fuel tank opening/closing unit and the gas tank opening/closing unit, based on an internal pressure of the fuel tank, wherein the control unit opens the gas storage tank to the communication passage after the control unit opens the canister opening/closing unit and the fuel tank to the communication passage, to reduce the internal pressure of the fuel tank.

2. The fuel evaporation gas discharge suppressing device of an internal combustion engine according to claim 1, further comprising:

an operating unit for accepting an operation for opening a filler port of the fuel tank, wherein the control unit reduces the internal pressure of the fuel tank when the operation for opening the filler port is accepted by the operating unit.

3. The fuel evaporation gas discharge suppressing device of an internal combustion engine according to claim 1, further comprising:

a pressure detecting unit for detecting the internal pressure of the fuel tank, wherein, when the internal pressure of the fuel tank is equal to or less than a predetermined value, the control unit closes the canister and opens the gas storage tank to the communication passage.

4. The fuel evaporation gas discharge suppressing device of an internal combustion engine according to claim 2, further comprising:

a pressure detecting unit for detecting the internal pressure of the fuel tank, wherein, when the internal pressure of the fuel tank is equal to or less than a predetermined value, the control unit closes the canister and opens the gas storage tank to the communication passage.

5. The fuel evaporation gas discharge suppressing device of an internal combustion engine according to claim 3, wherein the predetermined value is determined based on a capacity and an internal pressure of the gas storage tank.

6. The fuel evaporation gas discharge suppressing device of an internal combustion engine according to claim 4, wherein the predetermined value is determined based on a capacity and an internal pressure of the gas storage tank.

7. The fuel evaporation gas discharge suppressing device of an internal combustion engine according to claim 1, wherein an internal pressure of the gas storage tank is kept to be negative pressure, and wherein the negative pressure is generated by actuation of the internal combustion engine.

8. The fuel evaporation gas discharge suppressing device of an internal combustion engine according to claim 2, wherein an internal pressure of the gas storage tank is kept to be negative pressure, and wherein the negative pressure is generated by actuation of the internal combustion engine.

9. The fuel evaporation gas discharge suppressing device of an internal combustion engine according to claim 3, wherein an internal pressure of the gas storage tank is kept to be negative pressure, and wherein the negative pressure is generated by actuation of the internal combustion engine.

10. The fuel evaporation gas discharge suppressing device of an internal combustion engine according to claim 4, wherein an internal pressure of the gas storage tank is kept to be negative pressure, and wherein the negative pressure is generated by actuation of the internal combustion engine.

11. The fuel evaporation gas discharge suppressing device of an internal combustion engine according to claim 5, wherein an internal pressure of the gas storage tank is kept to be negative pressure, and wherein the negative pressure is generated by actuation of the internal combustion engine.

12. The fuel evaporation gas discharge suppressing device of an internal combustion engine according to claim 6, wherein an internal pressure of the gas storage tank is kept to be negative pressure, and wherein the negative pressure is generated by actuation of the internal combustion engine.

13. The fuel evaporation gas discharge suppressing device of an internal combustion engine according to claim 7, further comprising:

a communication opening/closing unit for opening and closing a communication between the communication passage and the air intake passage, wherein the control unit intermittently opens and closes the communication opening/closing unit during work of the internal combustion engine to cause the communication passage and the air intake passage to intermittently communicate with each other, and closes the canister and opens the gas storage tank to the communication passage to cause the internal pressure of the gas storage tank to be negative pressure.

14. The fuel evaporation gas discharge suppressing device of an internal combustion engine according to claim 8, further comprising:

a communication opening/closing unit for opening and closing a communication between the communication passage and the air intake passage, wherein the control unit intermittently opens and closes the communication opening/closing unit during work of the internal combustion engine to cause the communication passage and the air intake passage to intermittently communicate with each other, and closes the canister and opens the gas storage tank to the communication passage to cause the internal pressure of the gas storage tank to be negative pressure.

15. The fuel evaporation gas discharge suppressing device of an internal combustion engine according to claim 9, further comprising:

a communication opening/closing unit for opening and closing a communication between the communication passage and the air intake passage, wherein the control unit intermittently opens and closes the communication opening/closing unit during work of the internal combustion engine to cause the communication passage and the air intake passage to intermittently communicate with each other, and closes the canister and opens the gas storage tank to the communication passage to cause the internal pressure of the gas storage tank to be negative pressure.

16. The fuel evaporation gas discharge suppressing device of an internal combustion engine according to claim 10, further comprising:

a communication opening/closing unit for opening and closing a communication between the communication passage and the air intake passage, wherein the control unit intermittently opens and closes the communication opening/closing unit during work of the internal combustion engine to cause the communication passage and the air intake passage to intermittently communicate with each other, and closes the canister and opens the gas storage tank to the communication passage to cause the internal pressure of the gas storage tank to be negative pressure.

17. The fuel evaporation gas discharge suppressing device of an internal combustion engine according to claim 11, further comprising:

a communication opening/closing unit for opening and closing a communication between the communication passage and the air intake passage, wherein the control unit intermittently opens and closes the communication opening/closing unit during work of the internal combustion engine to cause the communication passage and the air intake passage to intermittently communicate with each other, and closes the canister and opens the gas storage tank to the communication passage to cause the internal pressure of the gas storage tank to be negative pressure.

18. The fuel evaporation gas discharge suppressing device of an internal combustion engine according to claim 12, further comprising:

a communication opening/closing unit for opening and closing a communication between the communication passage and the air intake passage, wherein the control unit intermittently opens and closes the communication opening/closing unit during work of the internal combustion engine to cause the communication passage and the air intake passage to intermittently communicate with each other, and closes the canister and opens the gas storage tank to the communication passage to cause the internal pressure of the gas storage tank to be negative pressure.

* * * * *